US006710583B2

(12) United States Patent
Stanescu et al.

(10) Patent No.: US 6,710,583 B2
(45) **Date of Patent: *Mar. 23, 2004**

(54) LOW DROPOUT VOLTAGE REGULATOR WITH NON-MILLER FREQUENCY COMPENSATION

(75) Inventors: Cornel D. Stanescu, Bucharest (RO); Radu H. Iacob, Santa Clara, CA (US)

(73) Assignee: Catalyst Semiconductor, Inc., Sunnyvale, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/340,492

(22) Filed: Jan. 10, 2003

(65) Prior Publication Data

US 2003/0102851 A1 Jun. 5, 2003

Related U.S. Application Data

(63) Continuation of application No. 09/968,358, filed on Sep. 28, 2001, now Pat. No. 6,518,737.

(51) Int. Cl.[7] ..... G05F 1/56
(52) U.S. Cl. ..... 323/280
(58) Field of Search ..... 323/273, 280, 323/281

(56) References Cited

U.S. PATENT DOCUMENTS

| | | | | |
|---|---|---|---|---|
| 5,559,424 | A | 9/1996 | Wrathall et al. | 323/280 |
| 5,563,501 | A | 10/1996 | Chan | 323/282 |
| 5,686,821 | A | 11/1997 | Brokaw | 323/273 |
| 5,861,736 | A | 1/1999 | Corsi et al. | 323/273 |
| 5,864,227 | A | 1/1999 | Borden et al. | 323/280 |
| 5,889,393 | A | 3/1999 | Wrathall et al. | 323/280 |
| 5,939,867 | A | 8/1999 | Capici et al. | 323/280 |
| 5,982,226 | A | 11/1999 | Rincon-Mora | 323/273 |
| 6,005,378 | A | 12/1999 | D'Angelo et al. | 323/313 |
| 6,046,577 | A | 4/2000 | Rincon-Mora et al. | 323/282 |
| 6,084,475 | A | 7/2000 | Rincon-Mora | 330/255 |
| 6,188,211 | B1 | 2/2001 | Rincon-Mora et al. | 323/281 |
| 6,246,221 | B1 | 6/2001 | Xi | 323/280 |
| 6,259,238 | B1 | 7/2001 | Hastings | 323/273 |
| 6,300,749 | B1 | 10/2001 | Castelli | 323/281 |
| 6,420,857 | B2 | 7/2002 | Fukui | 323/280 |
| 6,518,737 | B1 * | 2/2003 | Stanescu et al. | 323/280 |

OTHER PUBLICATIONS

G. A. Rincon–Mora, "Active Capacitor Multiplier in Miller–Compensated Circuits", IEEE J. Solid–State Circuits, vol. 35, pp. 26–32, Jan. 2000.

G. A. Rincon–Mora and P. E. Allen, "A low voltage, low quiescent current, low drop–out regulator", IEEE J. Solid–State Circuits, vol. 33, pp. 36–44, Jan. 1998.

K. M. Tham and K. Nagaraj, "A Low Supply Voltage High PSRR Voltage Reference in CMOS Process", IEEE J. Solid–State Circuits, vol. 30, pp. 586–590, May 1995.

C. Stanescu, "A 150mA LDO in 0.8μm CMOS process", Proceedings of CAS 2000 International Semiconductor Conference, IEEE Catalog No. 00TH8486, pp. 83–86, Oct. 2000.

* cited by examiner

*Primary Examiner*—Jeffrey Sterrett
(74) *Attorney, Agent, or Firm*—James E. Parsons; Bever, Hoffman & Harms, LLP

(57) ABSTRACT

A low dropout voltage regulator circuit with non-Miller frequency compensation is provided. The circuit includes an input voltage terminal; an output voltage terminal; an error amplifier having a first input coupled to a reference voltage; a voltage follower coupled to an output of the error amplifier; a pass device; and a feedback network. An input terminal of the pass device is coupled to the input voltage terminal. A control terminal of the pass device is coupled to an output of the voltage follower. An output terminal of the pass device is the output voltage terminal. The feedback network includes two resistors in series between the output voltage terminal and ground. A node between the resistors is coupled to a second input of the error amplifier. A frequency compensation capacitor also is coupled between the output voltage terminal and the node.

16 Claims, 5 Drawing Sheets

LOW DROPOUT VOLTAGE REGULATOR WITH NON-MILLER FREQUENCY COMPENSATION

CROSS-REFERENCE TO RELATED APPLICATION

This application is a continuation of U.S. patent application Ser. No. 09/968,358, filed Sep. 28, 2001 now U.S. Pat. No. 6,518,737, issued Feb. 11, 2003.

BACKGROUND OF THE INVENTION

1. Field of the Invention

The present invention relates to low dropout voltage regulators, and in particular, to those built in biCMOS and CMOS processes.

2. Description of the Related Art

Low dropout voltage regulators (LDOs) are used in power supply systems to provide a regulated voltage at a predetermined multiple of a reference voltage. LDOs have emerged as front-line integrated circuits (ICs) in the last decade, being used in palmtop and laptop computers, portable phones, and other entertainment and business products. Due to the growing need to save power, all battery-operated electronic systems use or will probably use LDOs with low ground current. More and more LDOs are built in bipolar complementary metal oxide semiconductor (biCMOS) and enhanced CMOS processes, which may provide a better, but not always cheaper product.

FIG. 1 is a simplified block diagram of a conventional CMOS low dropout positive voltage regulator LDO 10, which is based on FIGS. 2 and 3 of U.S. Pat. No. 5,563,501 (Chan). An unregulated input voltage VIN is applied to an input terminal 12. A bandgap reference 14 delivers a desired reference voltage to an inverting input line 16 of an error amplifier 18, which is an operational transconductance amplifier (OTA). A non-inverting input line 20 of the amplifier 18 is connected to the output of a negative feedback network (resistors R1 30 and R2 32). An output line 21 of the error amplifier 18 is coupled to the input of a buffer 22.

The buffer 22 in FIG. 1 is a voltage follower with an output stage (M24, M25, Q17, Q18 in FIG. 4 of U.S. Pat. No. 5,563,501) that provides a low output impedance to line 23, which is coupled to a high parasitic capacitance gate of a power p-channel metal oxide semiconductor (PMOS) path transistor 24 (path element). The power transistor 24 has its drain connected to an output terminal 26, where a regulated output voltage VOUT is available. The feedback network (R1 30 and R2 32) is a voltage divider, which establishes the value of VOUT. The feedback network consists of an upper resistor R1 30 connected between the output rail 26 and a node N1, and a lower resistor R2 32 connected between node N1 and a ground terminal 28.

As described in U.S. Pat. No. 5,563,501 (col. 1), a desirable LDO may have as small a dropout voltage as possible, where the "dropout voltage" is the voltage drop across the path element (power PMOS transistor 24 in FIG. 1), to maximize DC performance and to provide an efficient power system. To achieve a low dropout voltage, it is desirable to maximize the channel-width-to-channel-length ratio of the power PMOS transistor 24, which leads to a larger area and a large parasitic capacitance between gate and drain/source of the power PMOS transistor 24. Such large PMOS transistors, having a large parasitic capacitance between the gate and the drain/source, makes frequency compensation more difficult, affecting the transient response and permitting a high frequency input ripple to flow to the output.

Being a negative feedback system, an LDO needs frequency compensation to keep the LDO from oscillating. The LDO 10 in FIG. 1 performs frequency compensation by using an internal Miller compensation capacitor 34, which is connected through additional circuitry 36 between the output terminal 26 and line 21. In U.S. Pat. No. 5,563,501, the additional circuitry 36 is a current follower. The frequency compensation arrangement of the LDO 10 in FIG. 1 permits the use of a single, low-value external capacitor 40, having a low equivalent series resistance (ESR) 42, which may be intrinsically or externally added.

The buffer 22 in FIG. 1 is built using a foldback cascode operational amplifier with NPN input transistors and an NPN common-collector output stage. However, these NPN transistors are not available in standard digital N-well CMOS processes.

In another LDO disclosed in U.S. Pat. No. 6,046,577 (Rincon-Mora), the buffer 22 is built in a biCMOS process using two cascaded stages: a common-collector NPN voltage follower and a common-drain PMOS voltage follower.

G. A. Rincon-Mora discloses another solution for the buffer 22 in a paper entitled "Active Capacitor Multiplier in Miller-Compensated Circuits," IEEE J. Solid-State Circuits, vol. 35, pp. 26–32, January 2000, by replacing the first NPN stage with a common-drain NMOS, thus being closer to a CMOS process. Nevertheless, in order to eliminate the influence of bulk effects on the NMOS stage (for N-well processes), which affects power supply rejection ratio (PSRR), additional deep n+ trench diffusion and buried n+ layers are needed.

The frequency compensation used in the Rincon-Mora paper mentioned above is the same as that disclosed in U.S. Pat. No. 6,084,475 (Rincon-Mora), and is close to that of FIG. 1. The difference is that the Miller compensation capacitor 34 is connected between the output terminal 26 and an internal node of the error amplifier 18, as shown by the dotted line in FIG. 1. In this configuration, no additional circuitry 36 is needed.

SUMMARY OF THE INVENTION

The LDOs described above have several drawbacks, including: (1) the use of expensive biCMOS or enhanced CMOS processes, (2) limited closed-loop bandwidth, e.g., under 100 KHz, which may be caused by the output stage (M24, M25, Q17, Q18 in FIG. 4 of U.S. Pat. No. 5,563,501) in the buffer 22 of FIG. 1 or caused by other circuit elements, (3) non-ideal transient response, even at low ESR, due to a low slew-rate (SR) (maximum possible rate of change) provided for the internal capacitor 34 and/or due to the output stage (M24, M25, Q17, Q18 in FIG. 4 of U.S. Pat. No. 5,563,501) in the buffer 22 of FIG. 1 or due to other circuit elements, and (4) poor power supply rejection ratio (PSRR)(rejection of noise) at high frequency. Some of these limitations are disclosed in Rincon-Mora's paper (see FIGS. 7 through 9).

A low dropout voltage regulator with non-Miller frequency compensation is provided in accordance with the present invention. The low dropout voltage regulator comprises a first operational transconductance amplifier (OTA), a second OTA, a power p-channel metal oxide semiconductor (PMOS) transistor, and a feedback network. The first OTA has an inverting input, a non-inverting input and an output. The inverting input is coupled to a voltage reference circuit. The non-inverting input is coupled to a feedback network. The first OTA is configured to operate as an error amplifier. The second OTA has an inverting input, a non-inverting input and an output. The non-inverting input is coupled to the output of the first OTA. The output of the second OTA is coupled to the inverting input of the second OTA to form a voltage follower.

The power PMOS transistor has a source terminal, a drain terminal and a gate terminal. The source terminal is coupled to an input voltage terminal. The gate terminal is coupled to the output of the second OTA. The drain terminal is coupled to an output voltage terminal. The feedback network comprises a first resistor, a second resistor, and a frequency compensation capacitor. The first and second resistors are coupled in series between the output voltage terminal and a ground terminal. The frequency compensation capacitor is connected in parallel with the first (upper) resistor of the feedback network. The non-inverting input of the first OTA is coupled to a first node between the first and second resistors.

In order to optimize frequency compensation and transient response, by eliminating the need for a Miller compensation capacitor, both OTAs are designed with wide-band and low-power (low-current) circuit techniques. These wide-band, low-power OTAs enable the use, in addition to the single frequency compensation capacitor, of a single, low-value load capacitor with a low intrinsic equivalent series resistance (ESR).

Some conventional LDOs need high-value, externally-added ESRs to become stable. An LDO using a high-value ESR has the main disadvantage of a poor transient response: strong undershooting and overshooting. The LDO circuit according to the present invention may use the frequency compensation of a voltage regulator where the ESR specification does not exist, i.e., a voltage regulator with a simple load capacitor without an additional, external ESR and without choosing a particular type of load capacitor with a high intrinsic ESR over a temperature domain. In one embodiment, an LDO is stable with small and inexpensive load capacitors having a typical value of a few $\mu$F.

All parasitic poles from the signal path may be pushed to higher frequencies, producing a desired quasi single-pole behavior (the frequency response of a circuit may be characterized by poles and zeroes in a transfer function in the complex frequency s-domain).

To enhance the PSRR of the LDO according to the invention, the first wide-band OTA (error amplifier) may have a cascode second stage biased from the reference voltage, and the second OTA may have an additional PMOS transistor.

In one embodiment, a high efficiency LDO according to the invention may be advantageously built in a standard digital CMOS process, which allows lower manufacturing costs. A "standard digital CMOS process" is a CMOS technology process that provides standard NMOS and PMOS transistors without any specific enhanced properties. Any additional components (such as resistors, capacitors, etc.) in the circuit can be implemented using the same processing steps as implementing the standard NMOS and PMOS transistors. The standard digital CMOS process may be referred as an N-well CMOS technology, which does not require additional processing steps. In contrast, the biCMOS process (referred to in U.S. Pat. Nos. 5,563,501 and 6,046,577) and the enhanced CMOS process require additional processing steps, such as additional deep n+ trench diffusion and buried n+ layer (referred to in the above-referenced article "Active Capacitor Multiplier in Miller-Compensated Circuits"). The biCMOS process and the enhanced CMOS process are more expensive to use than a standard digital CMOS process. In other embodiments, the LDO according to the invention may be built in biCMOS or enhanced CMOS processes.

In one embodiment, an LDO according to the invention has an enhanced transient response closer to an ideal response, without using known Miller-type frequency compensation techniques. The enhanced transient response is due to a higher closed-loop bandwidth at maximum current, and elimination of an internal Miller capacitor.

In one embodiment, an LDO according to the invention has good PSRR at high frequency, due to the wide-band techniques and the lack of Miller-type frequency compensation.

Another aspect of the invention relates to a method of regulating an input voltage. The method comprises receiving an input voltage at a source terminal of a power p-channel metal oxide semiconductor (PMOS) path transistor; producing an output voltage at a drain terminal of the power PMOS transistor; comparing a reference voltage with a part of the output voltage; amplifying a difference between the part of the output voltage and the reference voltage; controlling a gate terminal of the power PMOS transistor in response to the amplified difference between the part of the output voltage and the reference voltage; and performing a non-Miller compensation, so that when a low-value, low intrinsic equivalent series resistance (ESR) load capacitor is coupled to the drain terminal, a behavior close to a single-pole loop, delivering a step and an almost undershoot and overshoot-free load transient response, is achieved.

DETAILED DESCRIPTION

Figure 2:
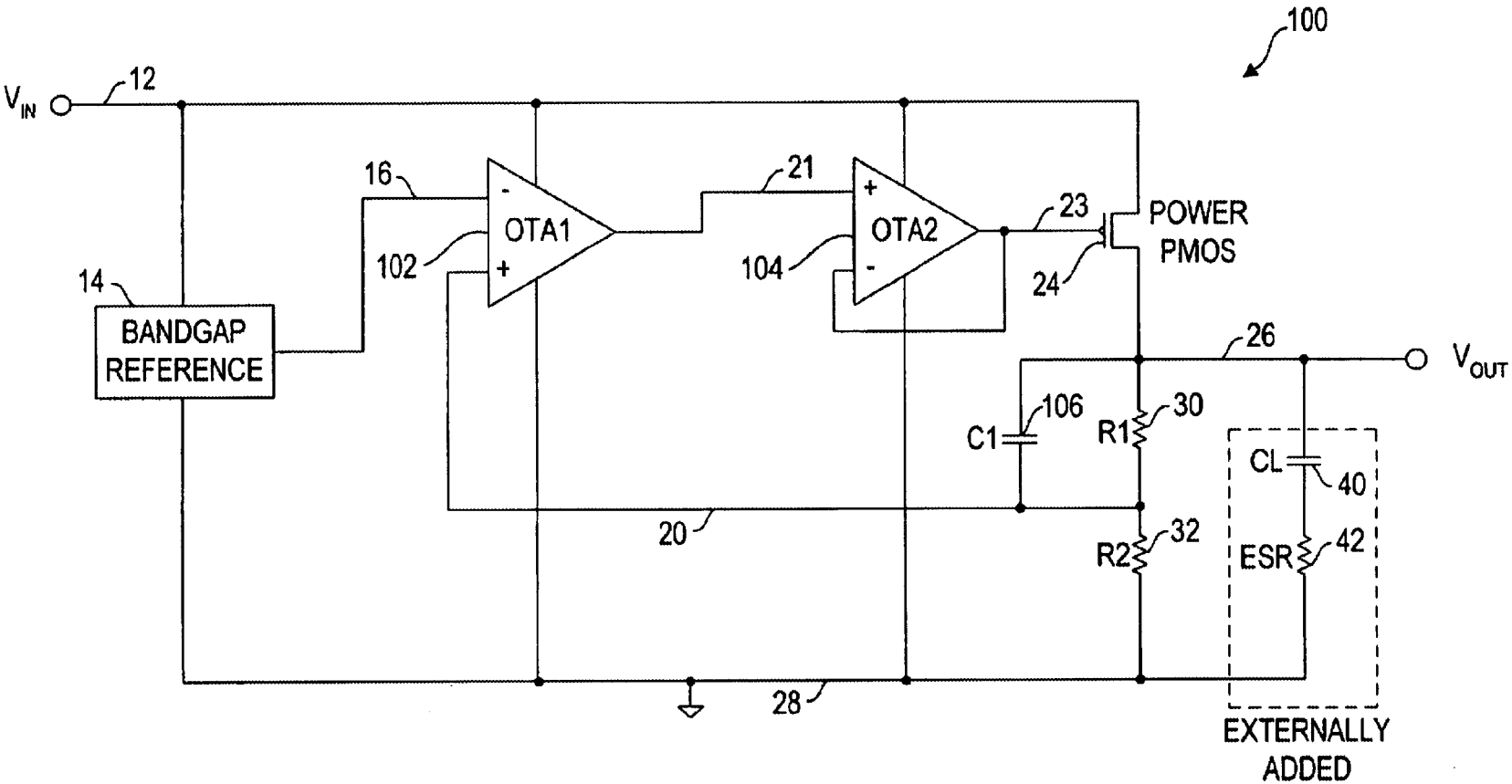
FIG. 2 is a simplified block diagram of one embodiment of a CMOS low dropout positive voltage regulator according to the invention.

FIG. 2 is a simplified block diagram of one embodiment of a CMOS low dropout positive voltage regulator (LDO) circuit 100 according to the invention. Some or all of the components of the LDO circuit 100 in FIG. 2 may be formed on a single microchip using a standard digital CMOS process. In one embodiment, the LDO circuit 100 in FIG. 2 is designed in a 0.8 $\mu$m CMOS process. In other embodiments, the LDO circuit 100 may be built in a biCMOS process or an enhanced CMOS process.

In one embodiment, the voltage bandgap reference 14 in FIG. 2 is an enhanced version of that presented by K. M. Tham and K. Nagaraj in the paper "A Low Supply Voltage High PSRR Voltage Reference in CMOS Process," IEEE J. Solid-State Circuits, vol. 30, pp. 586–590, May 1995, which is hereby incorporated by reference in its entirety. In one embodiment, the voltage bandgap reference 14 in FIG. 2 is shown in FIG. 2 of Cornel Stanescu's article entitled "A 150 mA LDO in 0.8 $\mu$m CMOS process," Proceedings of CAS 2000 International Semiconductor Conference, IEEE Catalog Number 00TH8486, pp. 83–86, October 2000, which is hereby incorporated by reference in its entirety. In one embodiment, the LDO circuit 100 functions properly with a supply voltage of about 2 volts.

Figure 1:
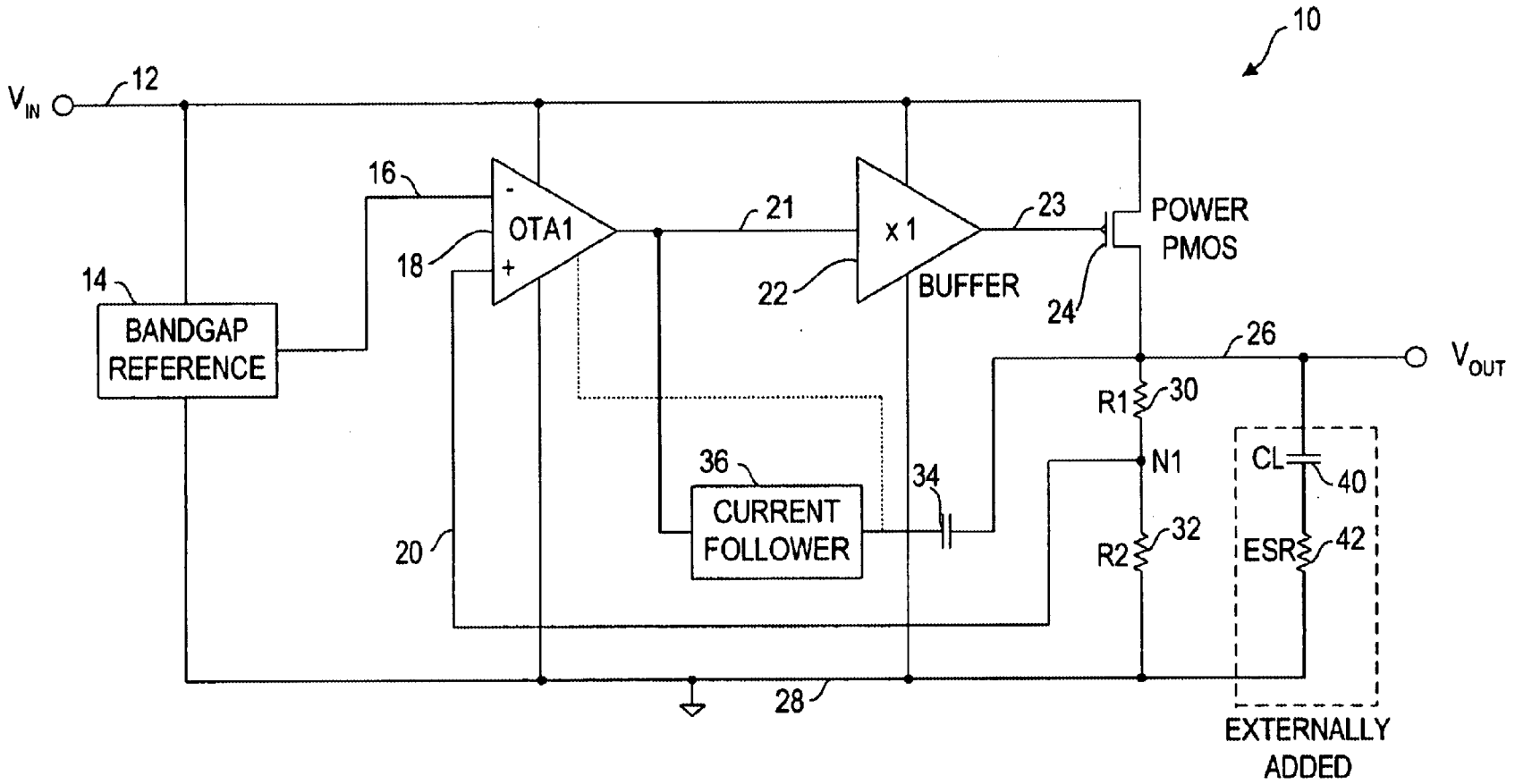
FIG. 1 (PRIOR ART)
FIG. 1 is a simplified block diagram of a CMOS low dropout positive voltage regulator.

The operational transconductance amplifier (OTA) 18 in FIG. 1 is replaced with a wide-band OTA 102 ("first wide-band OTA 102" or "OTA1") in FIG. 2, which may be built in a standard digital complementary metal oxide semiconductor (CMOS) process with wide-band, low-power circuit techniques. The term "wide-band" relates to architecture in the two OTAs 102, 104, which provide a single, high-impedance node on the signal path (the output). An actual bandwidth depends on desired and available fabrication processes and on an acceptable bias level. In one embodiment, a bandwidth from direct current (DC) to about 1 MHz alternating current (AC) may be considered "wide-band."

Figure 4:
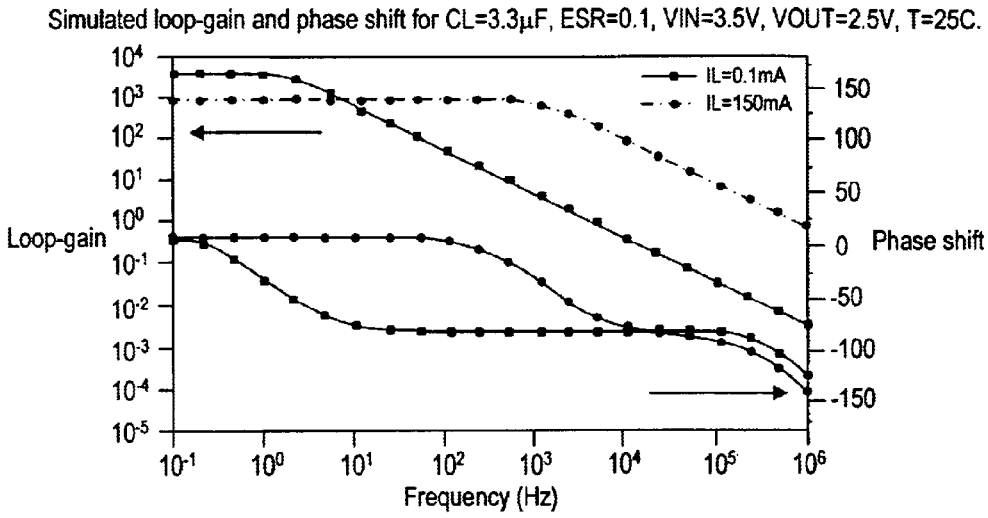
FIG. 4 illustrates simulated loop-gains and phase shifts vs. frequency responses of one embodiment of the LDO in FIG. 3 at minimum and full range load currents.

"Low-power" refers both to low supply voltage, such as a minimum of about 2V, and low bias current level, which is the current that flows through each stage of the OTAs 102, 104 (see FIG. 4). In one embodiment, the bias current has a value of about 1 $\mu$A to about 10 $\mu$A. Because an LDO is a voltage regulator, VIN is the supply voltage.

The first wide-band OTA 102 in FIG. 2 acts as an error amplifier and compares a part of the output voltage VOUT on node 26 (i.e., VOUT divided by R1 and R2) with a reference voltage from the bandgap reference 14. In one embodiment, a desired VOUT on node 26 ranges from about 1.8 volts to about 5 volts. The first OTA 102 generates a correction signal to a voltage follower (second OTA 104 in FIG. 2).

The buffer 22 in FIG. 1 is replaced with a unity-gain-configured wide-band OTA 104 ("second wide-band OTA 104" or "OTA2") in FIG. 2, which may be built in a standard digital complementary metal oxide semiconductor (CMOS) process and designed for wide-band, low-power operation. An output line 23 of the second wide-band OTA 104 is coupled to the inverting input of the second OTA 104 to form a voltage follower. The second OTA 104 drives the gate terminal of a power PMOS transistor 24. In one embodiment, the output of the second OTA 104 avoids reaching a potential below about 0.2–0.3V.

The Miller compensation network in FIG. 1, i.e., the compensation capacitor 34 and current follower 36, is not present in FIG. 2. A first frequency compensation capacitor 106 in FIG. 2 is placed in parallel with the upper resistor 30 of the voltage divider (R1 30 and R2 32). The capacitor 106 and the voltage divider (upper resistor 30 and lower resistor 32) in FIG. 2 provide a zero-pole pair, which enhances the phase margin (close to unity-loop-gain frequency) at a high load current.

In FIG. 2, a load capacitor 40 and its intrinsic equivalent series resistor (ESR) 42 are coupled to the VOUT node 26 externally, and both may have advantageously low values. The load capacitor 40 may comprise a tantalum-type capacitor or a multi-layer ceramic capacitor. In one embodiment, with a load current ($I_L$) of about 150 mA, a "low-value" load capacitor 40 may have a capacitance of about 1 $\mu$F to about 3.3 $\mu$F. In one embodiment, a "low-value" ESR 42 may have a resistance of about 0.01 ohm to about 1 ohm.

One goal of frequency compensation is to obtain a one-pole behavior for a loop-gain up to a maximum unity-loop-gain frequency (ULGF) by driving or pushing all parasitic poles to higher frequencies using design techniques and partially canceling or relocating parasitic poles by one or more additional zero and zero-pole pairs. Frequency compensation is shaped in the worst condition or worst case, which is for a maximum load current ($I_L$). In one embodiment, the worst case is when load current ($I_L$) is at a maximum, junction temperature ($T_J$) is at a maximum and VIN is at a minimum.

In order to push parasitic poles to higher frequencies, the design may take into account several factors. For example, a first parasitic pole ($f_{p1}$) is given by an output resistance ($R_{node21}$) of the first wide-band OTA 102 in FIG. 2 and a parasitic capacitance ($C_{node21}$) of both the first OTA's output capacitance and the input capacitance of the second wide-band OTA 104:

$$f_{p1}=1/(2\pi C_{node21}R_{node21}).$$

In order to maintain a low parasitic capacitance value ($C_{node21}$), the output stage (described below) of the first OTA 102 may be designed to be as small as possible for a desired amount of current (e.g., several $\mu$A), and the input transistors (described below) of the second OTA 104 may also be designed to be as small as possible (doubled for cross-coupling reasons). Also, the output resistance ($R_{node21}$) of the first OTA 102 may be designed to be under 1 Mohm, which excludes the use of a double cascode output stage.

The use of an additional low-output-resistance stage at the output of the first OTA 102, to transform the first OTA 102 to a true operational amplifier, may not be the best solution for the given requirements. The first OTA 102 may need more bias current and may not relocate $f_{p1}$ to a much higher frequency.

The gate-to-source parasitic capacitance ($C_{gs24}$) of the power PMOS transistor 24, and the output resistance ($R_{node23}$) of the unity-gain-configured OTA 104 give a second parasitic pole ($f_{p2}$):

$$f_{p2}=1/(2\pi C_{gs24}R_{node23}).$$

Because the parasitic capacitance value at line/node 23 ranges between about 10 picoFarads and about a few hundred pF (e.g., 100 pF), depending on the dimensions of the PMOS 24 and process, the output resistance ($R_{node23}$) of OTA 104 should be as low as possible.

There is a certain trade-off between the values of these parasitic poles ($f_{p1}$ and $f_{p2}$). If the second parasitic pole ($f_{p2}$) is pushed to a higher frequency by enlarging the input transistors of the second OTA 104 (which leads to a higher gain and a lower closed-loop resistance), then the first parasitic pole ($f_{p1}$) will relocate to a lower frequency due to the higher input capacitance of the second OTA 104.

One goal may be to obtain both parasitic poles ($f_{p1}$, $f_{p2}$) located at frequencies higher than twice the unity-loop-gain frequency (ULGF), which may be expressed as:

$$ULGF=f_d G_{LDc}.$$

$G_{LDC}$ is the DC loop-gain, which is dependent on the DC voltage gains of the first OTA 102 ($G_{102DC}$) and the PMOS 24 ($G_{24DC}$), and dependent on the global negative feedback network (R1 and R2):

$$G_{LDC}=G_{102DC}G_{24DC}(R_2/(R_1+R_2)).$$

$f_d$ is the frequency of the dominant pole:

$$f_d=1/(2\pi C_L R_{ds24})$$

where $$R_{ds24}=1/(\lambda I_L)$$

because the load current ($I_L$) may be very close to the drain current of the PMOS 24 ($\lambda$ is the channel-length modulation parameter). In one embodiment, the load is substantially an ideal sink-current generator.

In addition to the poles described above, there may be a zero-pole pair delivered by the feedback network, which may be expressed as:

$$f_{z1}=1/(2\pi C_1 R_1)$$

$$f_{p3}=1/(2\pi C_1(R_1 \| R_2))$$

where $R_1 \| R_2$ is equivalent to $(R_1R_2)/(R_1+R_2)$.

In a proper frequency compensation, $f_{z1}$ may be located as close as possible to $f_{p2}$, in order to cancel $f_{p2}$ (usually, $f_{p2}$ is lower than $f_{p1}$).

The output (load) capacitor 40, and its ESR 42 in FIG. 2 give a second zero:

$$f_{z2}=1/(2\pi C_L ESR).$$

$f_{z2}$ may be placed, for low-value ESR, higher than ULGF, canceling $f_{p1}$ or $f_{p3}$.

In one embodiment, the values of zeroes and parasitic poles are not correlated, and it may not be possible to match them as close as desired. Nevertheless, if all zeroes and parasitic poles are located higher than ULGF, this will not be a problem, except a few degrees of phase margin leading to a slight modification in transient response. As discussed herein, the LDO circuit 100 in FIG. 2 solves the main problem of frequency compensation with a method of pushing all the parasitic poles to higher frequencies, allowing stability for a desired loop-gain (imposed by a 0.075% or 1.0% load regulation) with a low-value, low-ESR external load capacitor 40.

In one embodiment, the LDO circuit 100 in FIG. 2 according to the present invention is recommended for low- and medium-valued ESRs 42. For a high-value ESR 42, some instability may occur. Some conventional LDOs needed high-value, externally-added ESRs to become stable. An LDO using a high-value ESR has the main disadvantage of a poor transient response: strong undershooting and overshooting. The LDO circuit 100 according to the present invention uses the frequency compensation of a voltage regulator where the ESR specification does not exist, i.e., a voltage regulator with a simple load capacitor without an additional, external ESR and without choosing a particular type of load capacitor with a high intrinsic ESR over a temperature domain.

One goal of an LDO may be to produce the best possible transient response within a given acceptable domain for the load capacitor 40 and the ESR 42, as opposed to being stable regardless of performance and cost.

Figure 3:
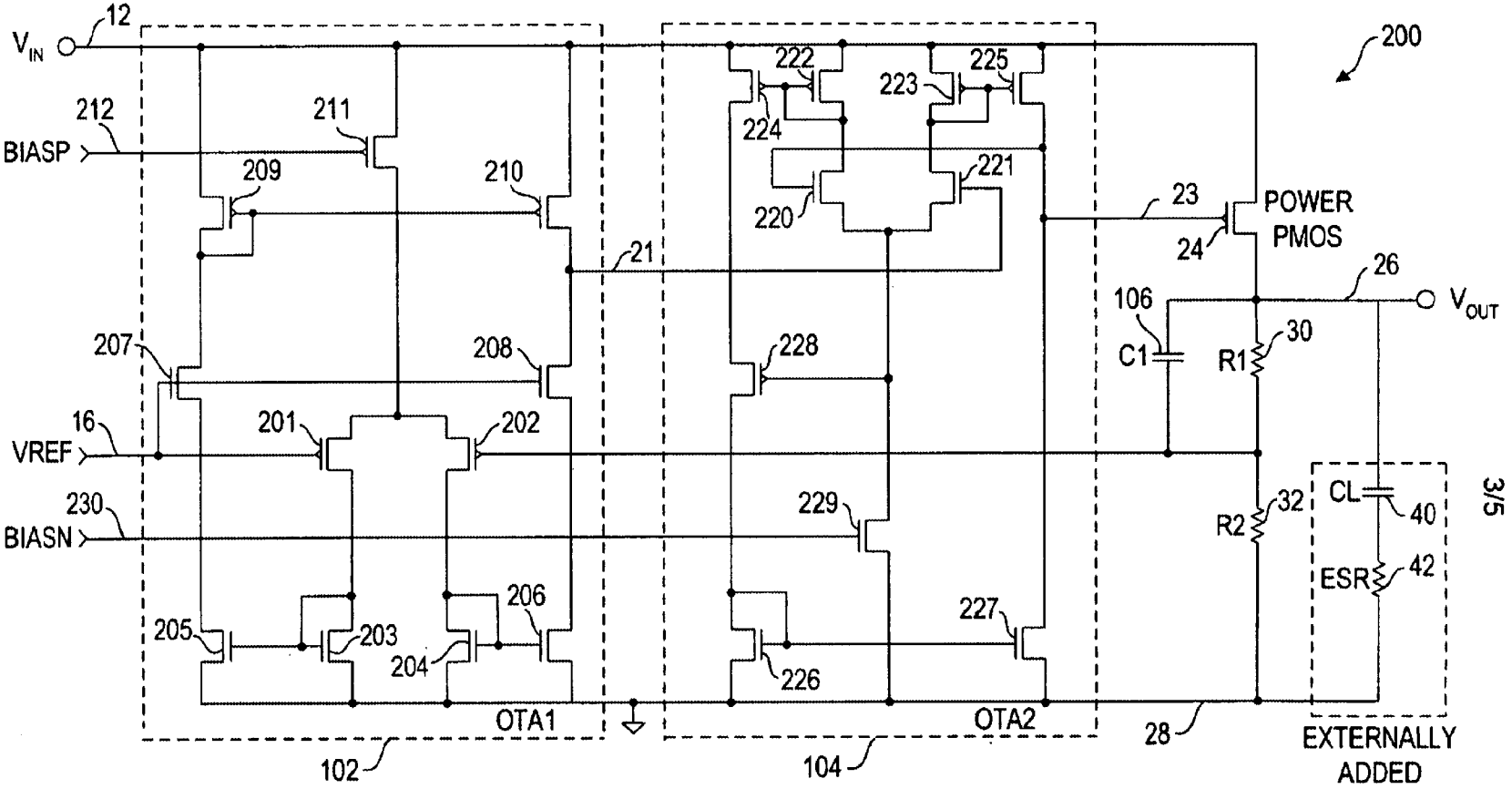
FIG. 3 is a detailed circuit schematic of one embodiment of the CMOS low dropout positive voltage regulator in FIG. 2.

FIG. 3 is a detailed circuit schematic 200 of one embodiment of the CMOS low dropout positive voltage regulator 100 in FIG. 2. Some or all of the components in the LDO circuit 200 of FIG. 3 may be implemented with a standard digital CMOS technology. In one embodiment, the LDO circuit 200 in FIG. 3 has a quiescent current of about 50 $\mu$A (if the current consumption of the bandgap reference block 14 in FIG. 2 is included, the quiescent current is about 70 $\mu$A). To achieve a low quiescent current, all stages of one embodiment of the circuit 200 in FIG. 3 may be designed for low power.

The first OTA 102 in FIG. 3 comprises two stages: an input differential stage and an output stage which is both a differential-to-single-ended converter and a current amplifier. The input differential stage comprises a pair of PMOS input transistors 201 and 202 and drives two diode-connected NMOS transistors 203 and 204.

The output stage comprises NMOS transistors 205 and 206 cascoded by NMOS transistors 207 and 208, driving the current mirror PMOS transistors 209 and 210. Transistors 205 and 206 are biased by the reference voltage VREF on line 16, which eliminates the influence of VIN variations upon the input offset voltage of the first OTA 102 and enhances PSRR. The operating point of the first OTA 102 is established by the current source from PMOS transistor 211, which is biased by BIASP on line 212. BIASP is available within the bandgap reference 14 (FIG. 2).

In one embodiment, a current ratio between transistors 206 and 205, respectively, (and transistors 208 and 207) is recommended to be three, in order to have a lower resistance at node 21 and still have a low current consumption. "Current ratio" here refers to a ratio of currents on branches of a current source. A ratio of drain currents ($I_D$S) of two transistors is dependent on the ratio of the widths (Ws) and lengths (Ls) of the two transistors. For example, transistor 207 has a channel width ($W_{207}$), a channel length ($L_{207}$) and a drain current ($I_{D207}$) that is proportional to $W_{207}/L_{207}$:

$$I_{D207} \sim (W_{207}/L_{207}).$$

Similarly, transistor 208 has a channel width ($W_{208}$), a channel length ($L_{208}$) and a drain current ($I_{D208}$) that is proportional to $W_{208}/L_{208}$:

$$I_{D208} \sim (W_{208}/L_{208}).$$

Assuming that the transistors 207, 208 are of the same type, e.g., low voltage NMOS transistors, the ratio of the two drain currents ($I_{D207}$ and $I_{D208}$) will be equal to the ratio of the channel widths and lengths of the two transistors 207, 208:

$$I_{D207}/I_{D208}=(W_{207}/L_{207})/(W_{208}/L_{208}).$$

In one embodiment, $L_{207}=L_{208}$ and $I_{D207}/I_{D208}$ may be expressed as:

$$I_{D207}/I_{D208}=W_{207}/W_{208}.$$

In one embodiment, $W_{207}/W_{208}=1/3$, which yields $I_{D207}/I_{D208}=1/3$.

Similarly, for transistors 205 and 206, $W_{205}/W_{206}=1/3$ and $I_{D205}/I_{D206}=1/3$. In one embodiment, $W_{204}/W_{206}=1/3$ and $I_{D204}/I_{D206}=1/3$. In one embodiment, $W_{204}=W_{203}=W_{205}$, $L_{204}=L_{203}=L_{205}$, $W_{201}=W_{202}$, $L_{201}=L_{202}$, $W_{209}/W_{210}=1/3$, and $L_{209}=L_{210}$.

The DC voltage gain of the first OTA 102 may be expressed as:

$$G_{102DC}=-g_{m201}R_{ds210}$$

where $g_{m201}$ represents the transconductance of the transistor 201. The DC voltage gain ($G_{102DC}$) may be limited to about 40 dB, in order to accomplish both the desired load regulation (e.g., 0.75% or 1.0%) and stability with low values for the load capacitor 40 and ESR 42.

The second OTA 104 in FIG. 3 may be a complementary modified version of the first OTA 102. In order to extend the common mode range (CMR), which affects the output swing in the case of a unity-gain configuration, an input stage of the second OTA 104 may comprise natural low-threshold voltage ($V_T$) NMOS transistors 220 and 221, which drive a load comprising two diode-connected PMOS transistors 222 and 223. "Natural" means NMOS transistors without threshold voltage implants, i.e., without p-type dopant implants that would increase threshold voltage ($V_T$). Thus, natural low-threshold voltage NMOS transistors may have a threshold voltage that is less than about 0.7 volts, such as 0.3 volts.

A second stage of the second OTA 104 may comprise PMOS transistors 224 and 225, which drive a current mirror load of NMOS transistors 226 and 227. In one embodiment, transistors 224 and 225 are not cascoded, and an additional PMOS transistor 228 keeps the drain-to-source voltage of transistor 224 less dependent upon VIN variations.

The output resistance ($R_{node23}$) at node 23 in FIG. 3 may be expressed as:

$$R_{node23}=1/(g_{m220}N)$$

where N is the current multiplication factor of the second stage of the second OTA 104:

$$N=(W/L)_{225}/(W/L)_{223}=(W/L)_{227}/(W/L)_{226}.$$

In one embodiment, in order to assure a low output resistance ($R_{node23}$), N is recommended to be 15. In one embodiment, the available supply current for the second OTA 104 is between about 20 $\mu$A and about 40 $\mu$A and is mainly diverted through output transistors 225 and 227, which increases the available slew rate (SR) at node 23 (speed of signal variation in node 23). In fact, the second OTA 104 may have a maximum output current:

$$I_{node23max}=NI_{D229}$$

which is almost double the operating point supply current $((N+1)I_{D229})/2$, giving a SR value of:

$$SR_{node23}=I_{node23max}/C_{gs24}.$$

The entire second OTA 104 may be biased by the drain current of NMOS transistor 229, which has a gate connected to a BIASN node 230, which is available within the bandgap reference 14 (FIG. 2).

Both bias nodes (BIASP 212 and BIASN 230) may impose proportional to absolute temperature (PTAT) supply currents for the first OTA 102 and the second OTA 104, which reduces the loop-gain dependence on temperature.

In one embodiment, the current flowing through the voltage divider (resistors 30 and 32) is chosen to be about 5 $\mu$A, which is higher than the maximum estimated leakage current of the power PMOS 24. A selected value of the compensation capacitor 106 may depend on a selected value of the resistor 30. The compensation capacitor 106 and the resistor 30 together produce a zero located at about 500 kHz to about 1 MHz, which enhances the phase margin for high load currents.

The configuration of the power PMOS transistor 24 in FIG. 3 may be selected in view of the targeted dropout value (DROPOUT) at the maximum load current ($I_L$) and junction temperature ($T_J$), and also in view of the available CMOS process. In one embodiment, for a DROPOUT($T_J$=125° C., $I_L$=150 mA)=350 mV, the PMOS 24 has a W=28,000$\mu$ and a L=1$\mu$.

The PMOS transistor 24 works as a common-source inverting amplifier, and its DC voltage gain may be expressed as:

$$G_{24DC}=-g_{m24}R_{ds24}.$$

The DC voltage gain ($G_{24DC}$) may decrease dramatically at high load current. This phenomenon is given by slower increase of the transconductance ($g_{m24}$) of the PMOS transistor 24 (which is proportional, in strong inversion, with the square root from $I_{D24}$), compared with the reduction of drain-to-source resistance $R_{ds24}$ (which is inversely-proportional with $I_{D24}$). Because the frequency of the dominant pole ($f_d$) may rise proportionally with the load current ($I_L$), e.g., $f_d$ is 1,500 times higher when $I_L$=150 mA compared with $I_L$=0.1 mA, the unity-loop-gain frequency (ULGF) reaches its upper limit at maximum load current.

In order to evaluate and validate the potential of the LDO circuit 200 in FIG. 3, SPICE simulations were generated with an extended schematic of the LDO circuit 200 in FIG. 3 and the bandgap reference 14 in FIG. 2.

FIG. 4 illustrates simulated loop-gains versus frequency responses (top two Bode plots in FIG. 4, as denoted by an arrow pointing to the left) and signal phase shifts (around the loop; measured in degrees) versus frequency responses (bottom two Bode plots in FIG. 4, as denoted by an arrow pointing to the right) of one embodiment of the LDO circuit 200 in FIG. 3 with the bandgap reference 14 in FIG. 2.

In FIG. 4, the loop-gain and phase shift plots are generated using a minimum load current ($I_L$=0.1 mA) and a full range load current ($I_L$=150 mA) with $V_{OUT}$=2.5V, $V_{IN}$=3.5V, $T_J$=25° C., $C_L$=3.3 $\mu$F and ESR=0.1Ω. (ESR may range from 0.01 to 1 ohm.) The $I_L$=0.1 mA loop-gain in FIG. 4 corresponds with the $I_L$=0.1 mA phase shift, while the $I_L$=150 mA loop-gain corresponds with the $I_L$=150 mA phase shift. The loop-gain/phase shift Bode plots in FIG. 4 may be used to analyze the stability of a feedback system, such as the LDO circuit 200 in FIG. 3.

For a minimum load current ($I_L$=0.1 mA) in FIG. 4, the loop-gain is higher, e.g., a DC loop-gain value of 2,600 may be obtained. The unity-loop-gain frequency (ULGF) is only 4.1 kHz, but the phase margin was found to be 89.80.

For $I_L$=150 mA in FIG. 4, the DC loop-gain is down to 640, but the unity-loop-gain frequency is increased up to 615 kHz, while the phase margin is reduced to 58.80, a lower, but still acceptable value. In one embodiment, the LDO circuit 200 in FIG. 3 is stable for a load capacitor of about 1 $\mu$F to about 10 $\mu$F, and an ESR 42 that is lower than about 1Ω.

In one embodiment, to avoid instability in a negative-feedback system, such as the LDO circuit 200 in FIG. 3, the total phase shift should be minimized, such that for unity loop-gain, the total phase-shift is still more positive than −180 degrees.

Figure 5:
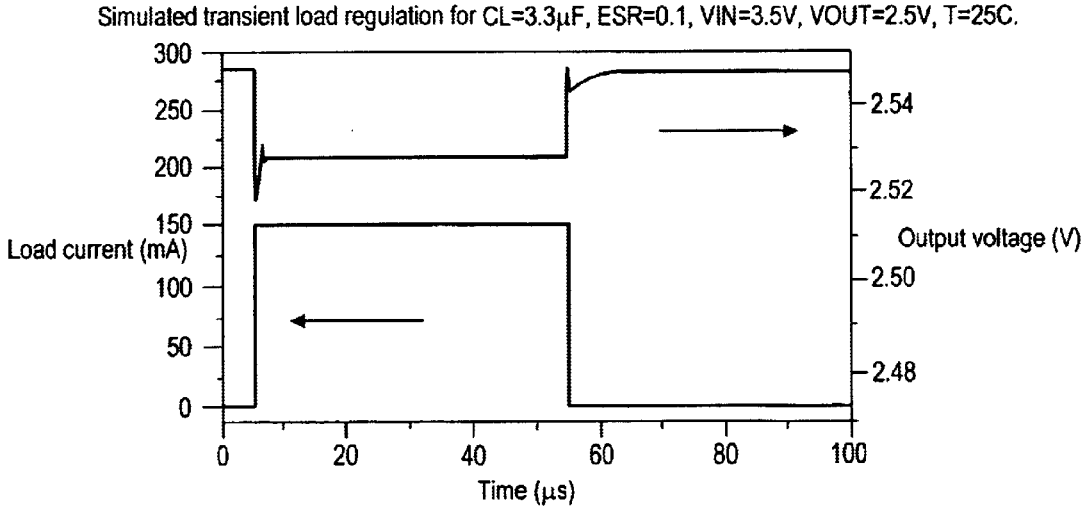
FIG. 5 illustrates a simulated transient voltage response of one embodiment of the LDO in FIG. 3 when a load current is rapidly pulsed from minimum to full range and back.

FIG. 5 illustrates a simulated transient voltage response (top plot in FIG. 5, as denoted by an arrow pointing to the right) of one embodiment of the LDO circuit 200 in FIG. 3 when a load current ($I_L$)(bottom plot in FIG. 5, as denoted by an arrow pointing to the left) is rapidly pulsed from minimum to full range and back with approximately 100 ns rise and fall times. In FIG. 5, the plots are generated using a $V_{IN}$=3.5V, $T_J$=25° C., $C_L$=3.3 $\mu$F and ESR=0.1Ω.

An important behavior of an LDO is the transient load regulation response (top plot in FIG. 5). In FIG. 5, the circuit output voltage (VOUT)(top plot in FIG. 5) manifests a step and almost undershoot-free transition (e.g., a small 8 mV undershoot) from stand-by value to full load, due to the relatively high bandwidth at high load current ($I_L$)(bottom plot in FIG. 5), good phase margin, and the lack of internal Miller capacitors which could delay the transition. The DC voltage value of load regulation may be a good value, such as −0.75% (e.g., −19.1 mV). When the load current ($I_L$) (bottom plot in FIG. 5) is rapidly pulsed back, the output voltage has a slower and substantially overshoot-free recovery, due to the lower bandwidth in stand-by.

The natural transient behavior (FIG. 5) of the LDO circuit 200 of FIG. 3 is more favorable compared to other LDO designs, including the LDO described in U.S. Pat. No. 6,046,577 and Rincon-Mora's paper mentioned above.

Figure 6:
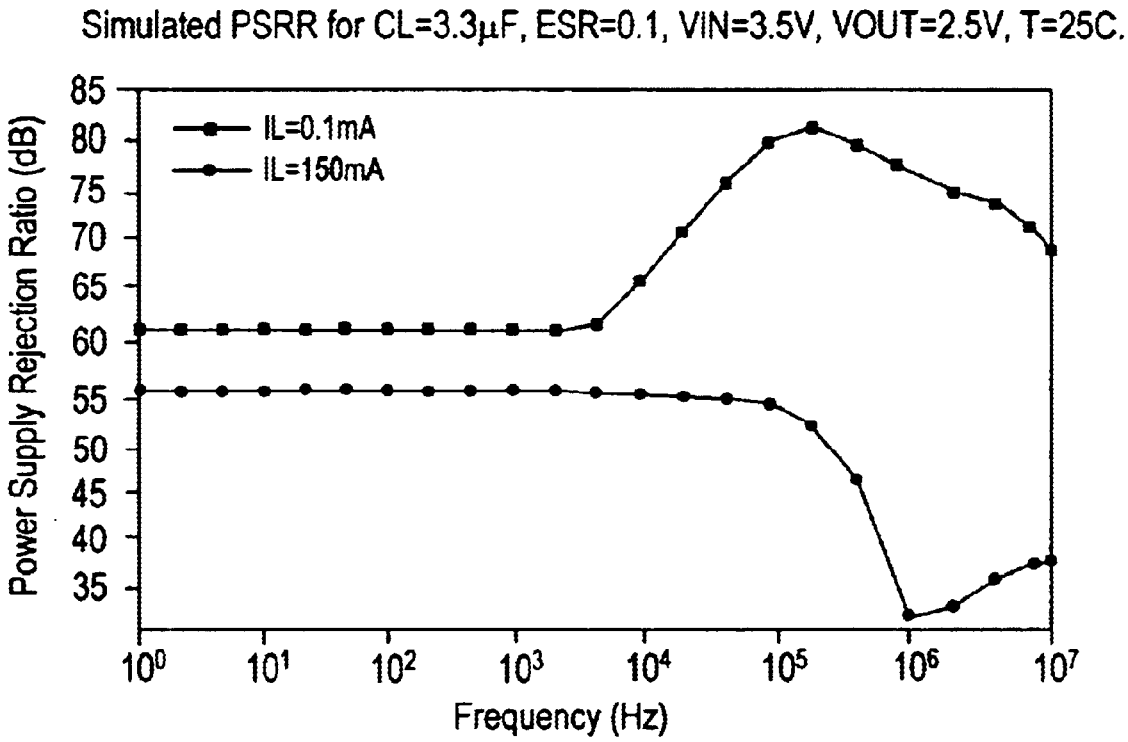
FIG. 6 illustrates a simulated PSRR vs. frequency of one embodiment of the LDO 200 in FIG. 3 at minimum and maximum load currents.

FIG. 6 illustrates a simulated PSRR vs. frequency of one embodiment of the LDO 200 in FIG. 3 at minimum and maximum load currents ($I_L$). In FIG. 6, the plots are generated using a $V_{IN}$=3.5V, VOUT=2.5V, $T_J$=25° C., $C_L$=3.3 $\mu$F and ESR=0.1Ω. At a minimum load current ($I_L$=0.1 mA), the DC value of PSRR may be about 62 dB. From about 5 kHz, the PSRR may increase up to about 82.4 dB at about 200 kHz, then decrease to about 71.2 dB at about 10 MHz.

At a maximum load current ($I_L$=0.1 mA), the shape of PSRR vs. frequency may be different: a lower DC value of about 55.8 dB is maintained up to over about 200 kHz, then a decrease down to about 35 dB at about 1 MHz, followed by a recovery to about 40.5 dB at about 10 MHz.

The above-described embodiments of the present invention are merely meant to be illustrative and not limiting. Various changes and modifications may be made without departing from the invention in its broader aspects. The appended claims encompass such changes and modifications within the spirit and scope of the invention.

What is claimed is:

1. A low dropout voltage regulator comprising:

a first operational transconductance amplifier (OTA) having an inverting input, a non-inverting input and an output, the inverting input being coupled to a voltage reference circuit, the non-inverting input being coupled to a feedback network, the first OTA being configured to operate as an error amplifier;

a second OTA having an inverting input, a non-inverting input and an output, the non-inverting input being coupled to the output of the first OTA, the output of the second OTA being coupled to the inverting input of the second OTA to form a voltage follower;

a power p-channel metal oxide semiconductor (PMOS) transistor having a source terminal, a drain terminal and a gate terminal, the source terminal being coupled to an input voltage terminal, the gate terminal being coupled to the output of the second OTA, the drain terminal being coupled to an output voltage terminal; and a feedback network comprising a first resistor and a second resistor, the first and second resistors being coupled in series between the output voltage terminal and a ground terminal, the non-inverting input of the first OTA being coupled to a first node between the first and second resistors, wherein the low dropout voltage regulator does not have a Miller frequency compensation capacitor.

2. The low dropout voltage regulator of claim 1, wherein the low dropout voltage regulator includes a plurality of transistors, and all of the transistors of the low dropout voltage regulator are MOS transistors.

3. The low dropout voltage regulator of claim 2, wherein the first OTA comprises:

an input differential stage including of a plurality of PMOS transistors driving a plurality of diode-connected NMOS transistors;

an output stage including of a first set of NMOS transistors cascoded by a second set of NMOS transistors driving a plurality of PMOS transistors; and wherein the second set of NMOS transistors are biased by the voltage reference circuit.

4. The low dropout voltage regulator of claim 2, wherein the second OTA comprises:

an input differential stage including a plurality of intrinsic NMOS transistors having a low threshold voltage driving a plurality of diode-connected PMOS transistors; and an output stage including a plurality of PMOS transistors driving a plurality of NMOS transistors.

5. The low dropout voltage regulator of claim 1, wherein the low dropout voltage regulator is a bipolar complementary metal oxide semiconductor (biCMOS) structure.

6. A low dropout voltage regulator comprising:

a first operational transconductance amplifier (OTA) having an inverting input, a non-inverting input and an output, the inverting input being coupled to a voltage reference circuit, the non-inverting input being coupled to a feedback network, the first OTA being configured to operate as an error amplifier;

a second OTA having an inverting input, a non-inverting input and an output, the non-inverting input being coupled to the output of the first OTA, the output of the second OTA being coupled to the inverting input of the second OTA to form a voltage follower;

a transistor having a source terminal, a drain terminal and a gate terminal, the source terminal being coupled to an input voltage terminal, the gate terminal being coupled to the output of the second OTA, the drain terminal being coupled to an output voltage terminal; and a feedback network comprising a first resistor, a second resistor, and a frequency compensation capacitor, the first and second resistors being coupled in series between the output voltage terminal and a ground terminal, the non-inverting input of the first OTA being coupled to a first node between the first and second resistors, and the frequency compensation capacitor being coupled between the output voltage terminal and the first node.

7. The low dropout voltage regulator of claim 6, wherein the transistor is a MOS transistor.

8. The low dropout voltage regulator of claim 7, wherein the transistor is a PMOS transistor.

9. The low dropout voltage regulator of claim 6, wherein the low dropout voltage regulator is a complementary metal oxide semiconductor (CMOS) structure.

10. The low dropout voltage regulator of claim 6, wherein the low dropout voltage regulator is a bipolar complementary metal oxide semiconductor (biCMOS) structure.

11. A low dropout voltage regulator comprising:

an input voltage terminal;

an output voltage terminal;

an error amplifier circuit having a first input coupled to a reference voltage source, a second input, and an output;

a voltage follower circuit having an input coupled to the output of the error amplifier, and an output;

a pass device having an input terminal, an output terminal, and a control terminal, the input terminal being coupled to the input voltage terminal, the control terminal being coupled to the output of the voltage follower, and the output terminal being coupled to the output voltage terminal; and a feedback network comprising a first resistor, a second resistor in series with the first resistor, and a frequency compensation capacitor, the first resistor being coupled between the output voltage terminal and a first node, the second resistor being coupled between the first node and a ground terminal, the second input of the error amplifier being coupled to the first node, and the frequency compensation capacitor being coupled between the output voltage terminal and the first node.

12. The low dropout voltage regulator of claim 11, wherein the pass device is a MOS transistor.

13. The low dropout voltage regulator of claim 12, wherein the pass device is a PMOS transistor.

14. The method of claim 12, wherein the method is performed in a biCMOS structure.

15. The method of claim 11, wherein the method is performed in a CMOS structure.

16. A method of regulating an input voltage signal, the method comprising:

receiving an input voltage at an input terminal of a pass device;

producing an output voltage at an output terminal of the pass device;

comparing a reference voltage with a part of the output voltage;

amplifying a difference between the part of the output voltage and the reference voltage;

driving a control terminal of the pass device in response to the amplified difference between the part of the output voltage and the reference voltage; and performing a non-Miller frequency compensation.

* * * * *